US011208318B2

(12) United States Patent
Christopherson et al.

(10) Patent No.: US 11,208,318 B2
(45) Date of Patent: Dec. 28, 2021

(54) ADJUSTABLE SPILL CONTAINMENT SYSTEM

(71) Applicant: Franklin Fueling Systems, LLC, Madison, WI (US)

(72) Inventors: Michael Christopherson, Monona, WI (US); James Matthew Novak, Evansville, WI (US); Bill Nelson, Lake Mills, WI (US)

(73) Assignee: FRANKLIN FUELING SYSTEMS, LLC, Madison, WI (US)

( * ) Notice: Subject to any disclaimer, the term of this patent is extended or adjusted under 35 U.S.C. 154(b) by 5 days.

(21) Appl. No.: 16/695,708

(22) Filed: Nov. 26, 2019

(65) Prior Publication Data

US 2020/0165121 A1 May 28, 2020

Related U.S. Application Data

(60) Provisional application No. 62/772,505, filed on Nov. 28, 2018.

(51) Int. Cl.

| | |
|---|---|
| ***B67D 7/32*** | (2010.01) |
| ***B65D 90/10*** | (2006.01) |
| ***B67D 7/78*** | (2010.01) |

(52) U.S. Cl.

CPC ..... *B67D 7/3209* (2013.01); *B65D 90/105* (2013.01); *B67D 7/78* (2013.01)

(58) Field of Classification Search

CPC ..... B65D 90/105; B67D 7/3209; B67D 7/78
USPC ..... 220/567.1, 567.2; 285/127.1, 148.19, 285/153.1, 184
See application file for complete search history.

(56) References Cited

U.S. PATENT DOCUMENTS 850,731 A * 4/1907 Christensen et al. ..... F16L 27/0849 285/184
1,475,867 A * 11/1923 Peterson ..... F16L 23/12 285/184
1,913,246 A * 6/1933 Saine ..... F16L 27/053 285/334.4
3,429,588 A * 2/1969 Nelson ..... F16L 27/04 285/11
4,618,170 A * 10/1986 Fishburne ..... F16L 27/00 285/184
4,696,494 A * 9/1987 Schmitz ..... F16L 27/06 285/18

(Continued)

*Primary Examiner* — Timothy L Maust
(74) *Attorney, Agent, or Firm* — Faegre Drinker Biddle & Reath LLP

(57) ABSTRACT

A tank collar has an adjustable mounting surface for a containment sump, such that the containment sump may be adjusted on the tank collar to be substantially plumb, even if the tank collar itself is not plumb. In particular, the containment sump wall is angularly adjustable with respect to the tank collar, which is fixed to an underground storage tank (UST). This angular adjustability facilitates a method of installation in which imperfect angular orientation of the tank collar and UST may be compensated for by angular adjustment of the containment sump wall. During and after such angular adjustment, a consistent seal between the containment sump wall and the tank collar is maintained, such as in the form of a continuous line of contact around the circumference of the interface between the tank collar and the containment sump wall.

28 Claims, 12 Drawing Sheets

(56) References Cited

U.S. PATENT DOCUMENTS

| | | | | |
|---|---|---|---|---|
| 5,069,487 | A * | 12/1991 | Sheppard | F01N 13/1811 285/226 |
| 5,171,042 | A * | 12/1992 | Faidiga | F16L 13/0263 285/184 |
| 6,266,928 | B1 * | 7/2001 | Argandona | B65D 90/105 220/567.1 |
| 7,575,015 | B2 * | 8/2009 | Reid | G01M 3/2892 137/15.11 |
| 9,435,463 | B2 * | 9/2016 | Riggs | F16L 3/00 |
| 2003/0136789 | A1 * | 7/2003 | Bolzer | B65D 88/76 220/567.1 |
| 2008/0099490 | A1 * | 5/2008 | Burwell | B65D 88/76 220/567.1 |
| 2008/0122221 | A1 * | 5/2008 | Bridgewater | F16L 27/04 285/184 |
| 2011/0203192 | A1 * | 8/2011 | Schneider | E02D 29/124 52/20 |
| 2012/0255958 | A1 * | 10/2012 | Joseph | B67D 7/3236 220/567.1 |

* cited by examiner

ADJUSTABLE SPILL CONTAINMENT SYSTEM

CROSS-REFERENCE TO RELATED APPLICATIONS

This application claims the benefit under Title 35, U.S.C. § 119(e) of U.S. Provisional Patent Application Ser. No. 62/772,505, entitled ADJUSTABLE SPILL CONTAINMENT SYSTEM and filed on Nov. 28, 2018, the disclosure of which is expressly incorporated by reference herein in its entirety.

FIELD OF THE DISCLOSURE

The present disclosure relates generally to fluid containment systems and, more particularly, to fuel containment sumps positioned between a fuel dispenser and an underground storage tank.

BACKGROUND OF THE DISCLOSURE

Containment sumps may be included in fueling systems to transition pipe lines, electrical lines, or other conduits between various components of the fueling system. For example, under-dispenser containment (UDC) sumps are located under fuel dispensers and contain piping and valves for distribution of hydrocarbon product such as gasoline from underground storage tanks (UST) to a customer-accessible fuel dispenser. Tank sumps are used to provide access to the interior of the UST for filling and inspection. Transition sumps are used to transition conduit from underground to above-ground locations. These and other sumps structures may be collectively referred to as "containment sumps" for a fueling system.

A UST is installed by excavating a hole below a service station site, lowering the UST into the excavated hole, and then backfilling material around the UST. Containment sumps are then installed at appropriate locations along the top surface of the UST, such that the open top of the containment sump is approximately level with grade. Additional material may then be backfilled around the containment sump, and a level concrete driving surface may be created around the UST and the lid of the containment sump positioned atop the UST.

SUMMARY OF THE DISCLOSURE

The present disclosure provides a tank collar with an adjustable mounting surface for a containment sump, such that the containment sump may be adjusted on the tank collar to be substantially plumb, even if the tank collar itself is not plumb. In particular, the containment sump wall is angularly adjustable with respect to the tank collar, which is fixed to an underground storage tank (UST). This angular adjustability facilitates a method of installation in which imperfect angular orientation of the tank collar and UST may be compensated for by angular adjustment of the containment sump wall. During and after such angular adjustment, a consistent seal between the containment sump wall and the tank collar is maintained, such as in the form of a continuous line of contact around the circumference of the interface between the tank collar and the containment sump wall.

In one form thereof, the present disclosure provides a tank collar including a lower portion having a lower end shaped to form a lower fluid-tight seal with an external surface of an underground storage tank, and an upper portion having a cylindrical wall terminating in an upper end surface defining a spheroidal mounting surface configured to mate with a correspondingly sized containment sump wall, whereby the spheroidal mounting surface can form a sealed interface between the upper end surface and the containment sump wall while also allowing angular adjustment of the containment sump wall with respect to the tank collar.

In another form thereof, the present disclosure provides a containment sump including a tank collar having a cylindrical sidewall with a lower end and an opposing upper end, and a containment sump wall having a lower end sealingly engaged with the upper end of the tank collar, the sump containment angularly adjustable with respect to the tank collar within a predetermined angular range.

In yet another form thereof, the present disclosure provides a fueling station including an underground storage tank having a tank collar affixed to an outer surface thereof, the tank collar having an upper end, and a containment sump comprising a containment sump wall having a lower end sealingly engaged with the upper end of the tank collar, the sump containment angularly adjustable with respect to the tank collar within a predetermined angular range.

In still another form thereof, the present disclosure provides a method of assembling a containment sump to an underground storage tank, the method including installing the underground storage tank below grade, the underground storage tank having a tank collar fixed to an exterior surface thereof, installing a containment sump wall to the tank collar to create a seal therebetween, and angularly adjusting the containment sump wall with respect to the tank collar without disrupting the seal.

The above-mentioned and other features of the invention and the manner of obtaining them will become more apparent and the invention itself will be better understood by reference to the following description of exemplary embodiments of the invention taken in conjunction with the accompanying drawings.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
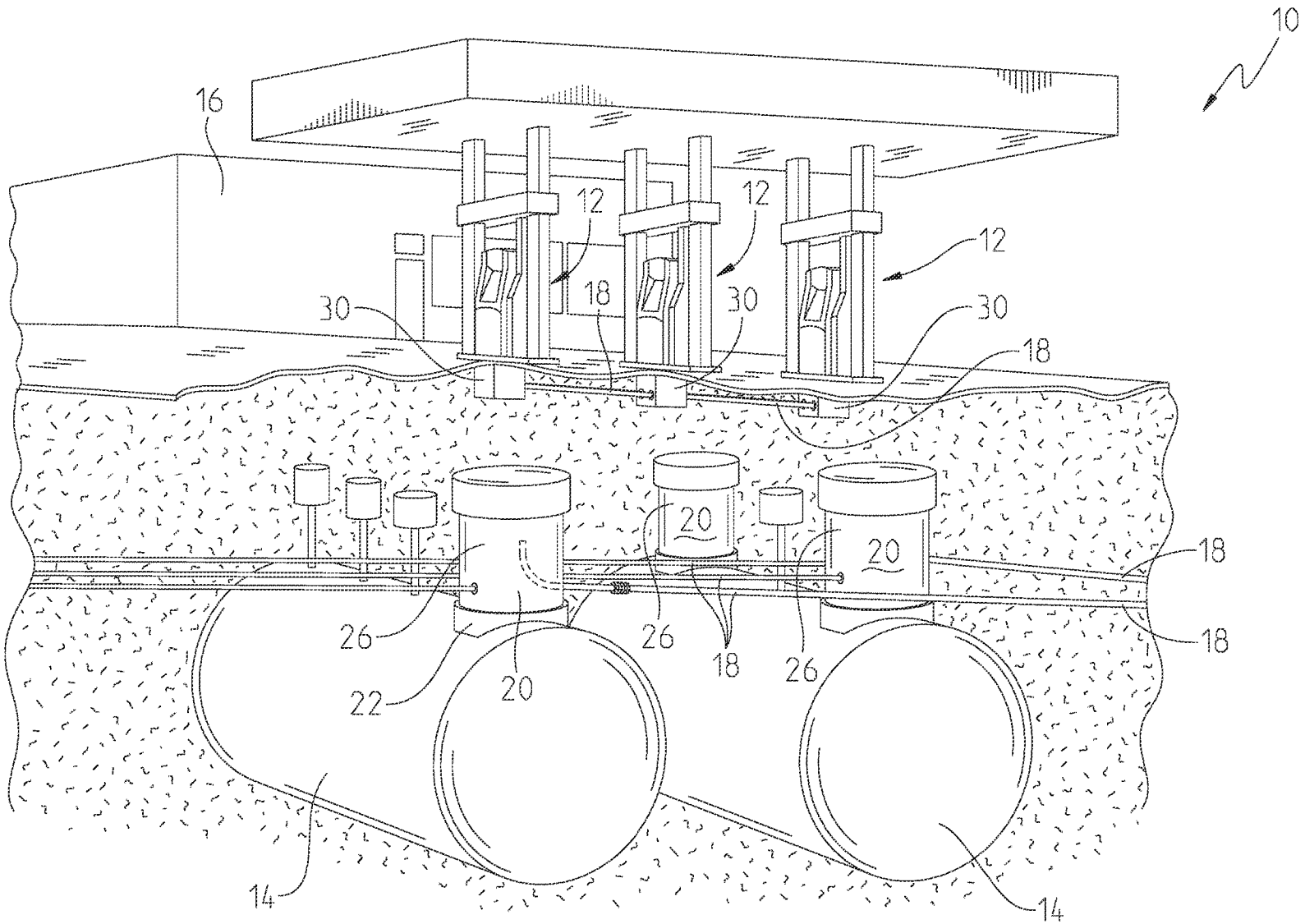
FIG. 1 is a perspective view of a fueling station incorporating containment sumps connected to an underground storage tank.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 9:
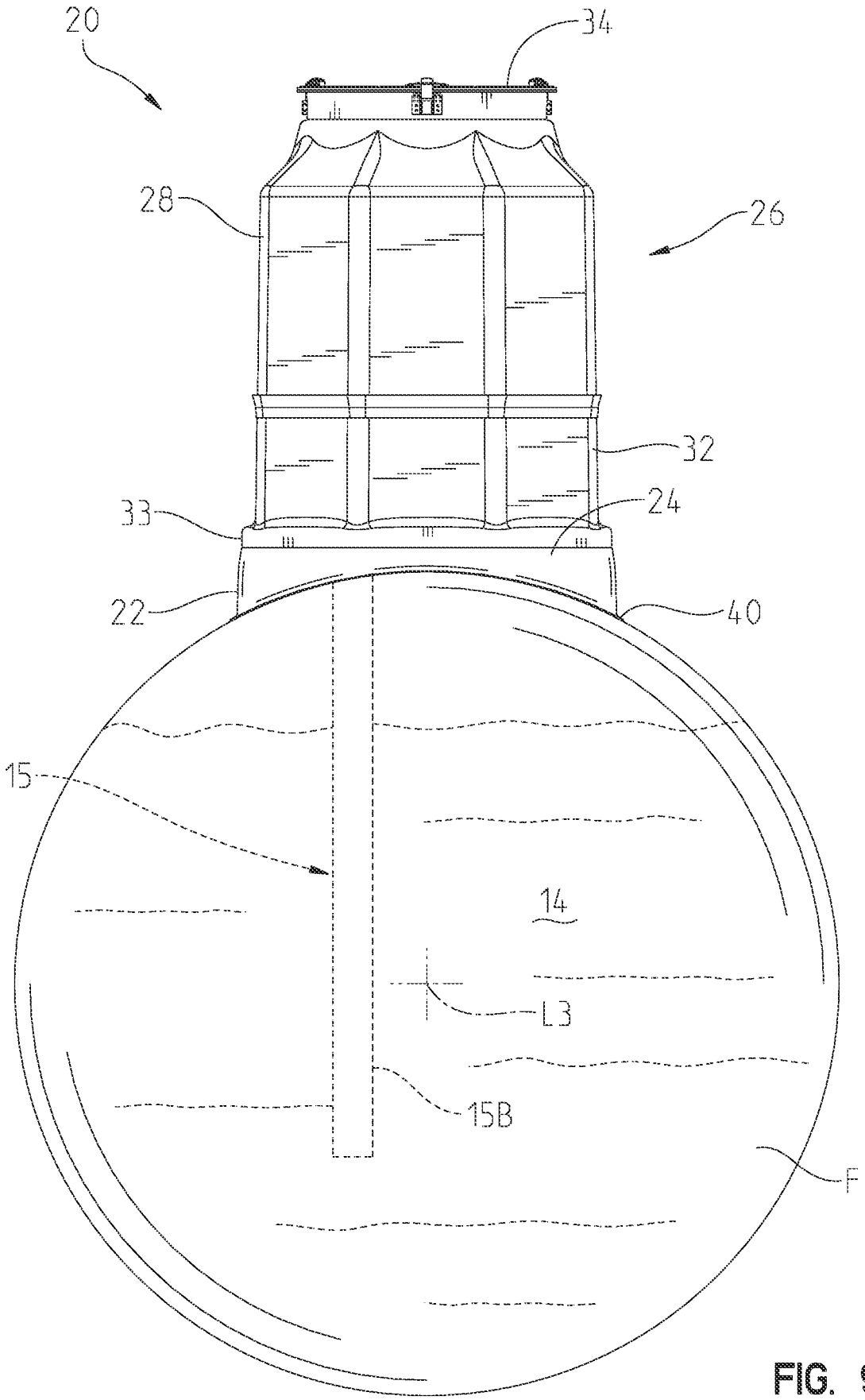
FIG. 9 is a side elevation view of the containment sump assembly and underground storage tank shown in FIG. 7, after assembly.

Referring to FIG. 1, fueling station 10 includes a plurality of fuel dispensers 12 in fluid communication with underground storage tanks (USTs) 14. As is typical in such installations, fuel nozzles associated with each fuel dispenser 12 can be utilized to dispense hydrocarbon product stored in one of underground storage tanks 14 to, e.g., a vehicle or storage container. To effect the transfer of hydrocarbon product from underground storage tanks 14 through fuel dispensers 12, fuel dispensers 12 each have a fluid and electrical connection to, e.g., submersible pump system 15 including a pump head 15A (FIG. 2B) and a pump conduit 15B (FIG. 9) immersed in hydrocarbon product F contained in one of underground storage tanks 14 (FIG. 9).

In an exemplary embodiment, fuel dispensers 12 are also electrically connected with at least one fuel control and monitoring system contained in control building 16. Control building 16 may also houses fueling station attendants who may monitor and manipulate the fuel control and monitoring system. One exemplary such control and monitoring system, designed to work in the context of fueling station 10 and control building 16, is described in U.S. Pat. No. 9,352,951, filed Sep. 28, 2012 and entitled "FUEL DELIVERY MANAGEMENT SYSTEM", the entire disclosure of which is hereby expressly incorporated herein by reference.

Various buried conduits 18 are run between the various components of fueling station 10 to convey fluid, electrical lines, or the like, as best shown in FIG. 1. As shown in FIG. 2B, conduits 18 may pass through the walls 26 of respective containment sumps 20, where junctions are made with other structures such as pump system 15. Additional details of exemplary fluid-tight conduits which may be used in connection with containment sumps 20 and/or 30 are described in U.S. Patent Application Publication No. 2019/0211948, filed Jul. 27, 2018 and entitled WATERTIGHT ELECTRICAL CONDUIT, the entire disclosure of which is hereby expressly incorporated herein by reference.

Turning again to FIG. 1, tank sumps 20 are shown positioned atop underground storage tanks 14. Sumps 20 can contain a variety of components as shown in FIG. 2B, including electrically controlled components and the riser pipe/drop tube combination providing for fluid communication with the associated underground storage tank 14, for example. Electrical lines positioned through conduits in fueling station 10 include high voltage cables such as power cables and low voltage cables such as communication cables connected to, for example, sensors, probes or displays. Fuel conduits 18 may also extend between and among the components of fueling station 10, such as between underground storage tank 14 and dispensers 12 as further described herein. An exemplary design for tank sump 20 which may be used in connection with the present disclosure is described in U.S. Patent Application Publication No. 2018/0257925 filed Mar. 7, 2018 and U.S. patent application Ser. No. 16/557,363 filed Aug. 30, 2019, both entitled METHOD AND APPARATUS FOR LIMITING ACIDIC CORROSION AND CONTAMINATION IN FUEL DELIVERY SYSTEMS, the entire disclosures of which are hereby expressly incorporated herein by reference.

Dispenser sumps 30 are also positioned under each fuel dispenser 12 as shown in FIG. 1. An exemplary dispenser sump 30 useable in connection with the present disclosure is disclosed in U.S. patent application Ser. No. 16/585,211, filed Sep. 27, 2019 and entitled SPILL CONTAINMENT SYSTEM, the entire disclosure of which is hereby expressly incorporated by reference herein.

Turning now to FIGS. 2A-11, collar 22 is shown in the context of tank sump 20. For efficiency, collar 22 will be described with respect to its interface with tank sump 20, it being understood that the design of collar 22 may also be applied to other sump designs, including designs for dispenser sumps 30, as required or desired for a particular application. In particular, it is contemplated that any other cylindrical sump portion, or any round sump structure positioned to interface with tank collar 22, may utilize the design principles of collar 22 in accordance with the present disclosure.

Figure 10A:
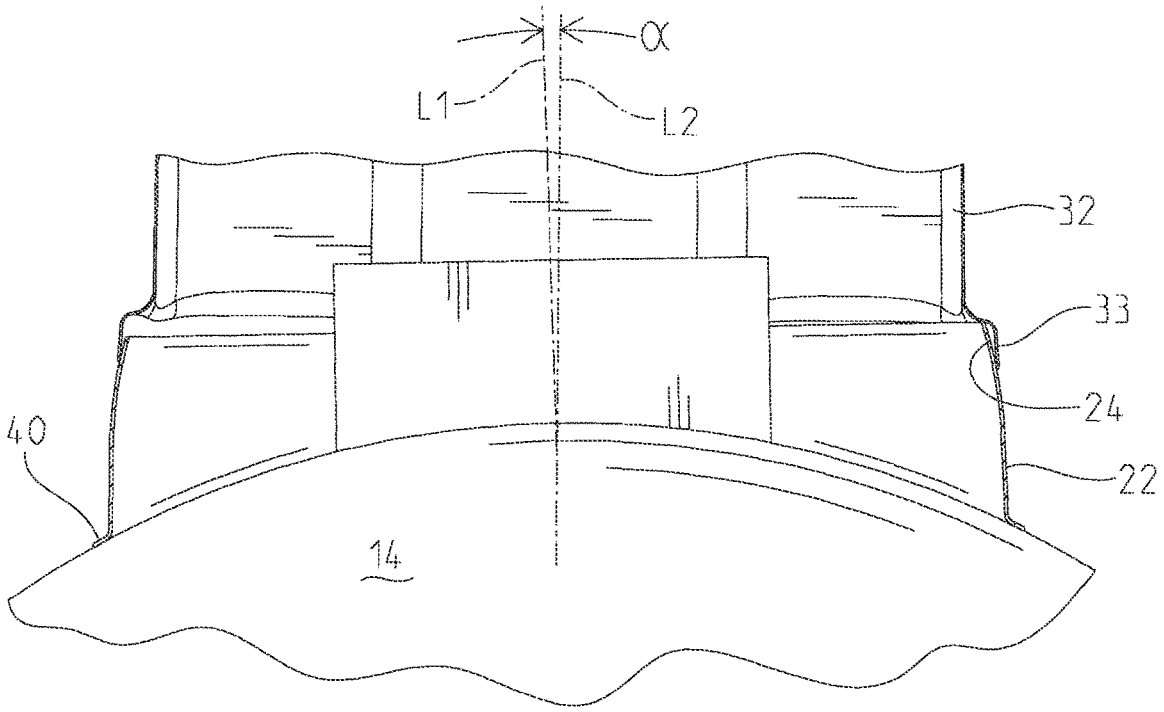
FIG. 10A is an enlarged portion of the assembly shown in FIG. 9, in which the longitudinal axis of the tank collar and containment sump wall are askew.
Figure 10B:
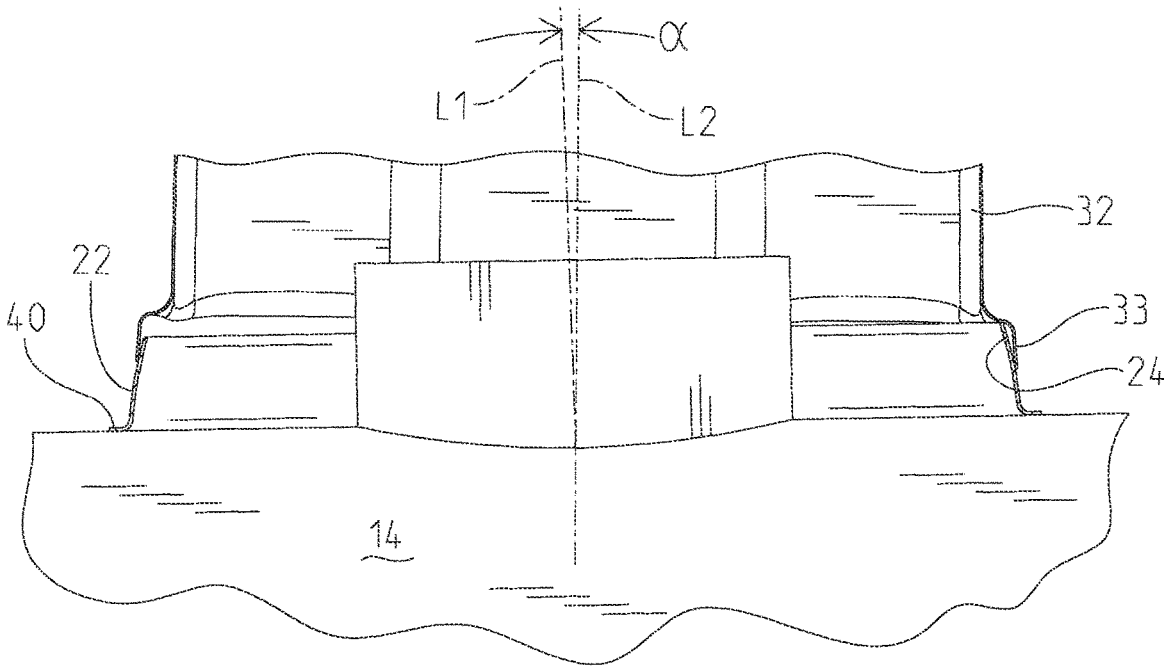
FIG. 10B is another side elevation view of the assembly shown in FIG. 10A, rotated by 90 degrees.
Figure 11:
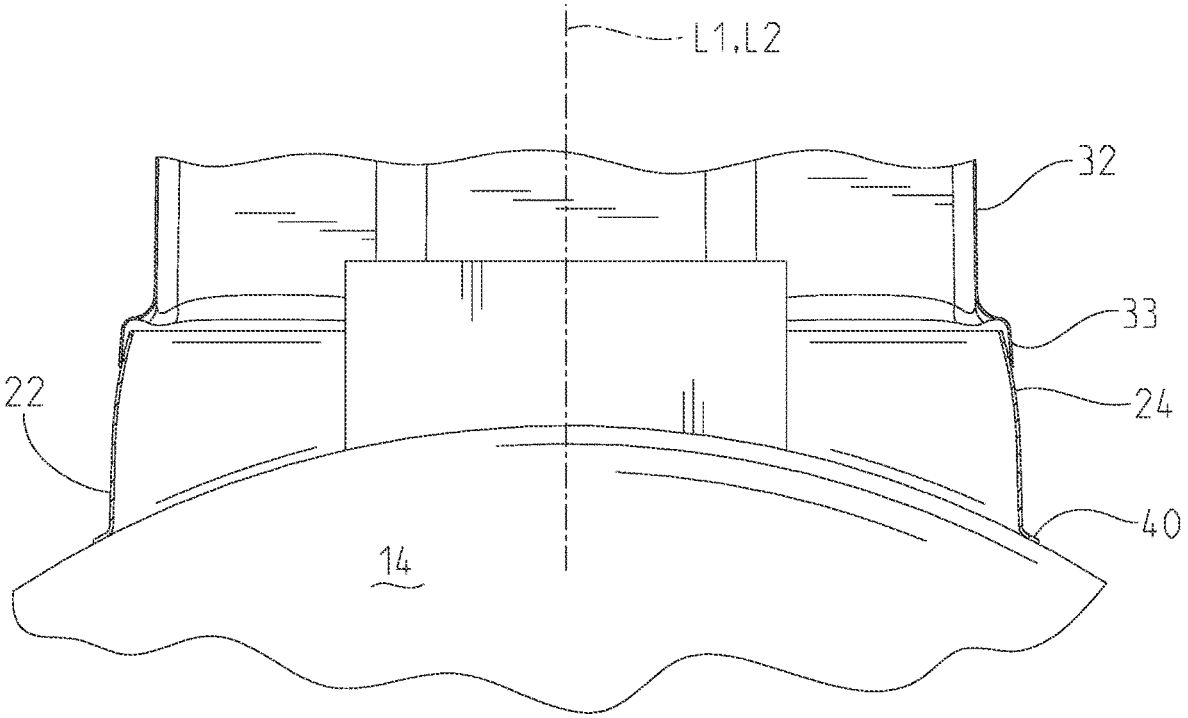
FIG. 11 is an enlarged portion of the assembly shown in FIG. 9, in which the longitudinal axis of the tank collar and containment sump wall are parallel and coincident.

As best seen in FIGS. 10A, 10B and 11, collar 22 is a round, generally cylindrical structure defining a longitudinal axis L. Collar 22 has a rounded upper lip 24 which allows for angular skewing of longitudinal axis L2 defined by the outer wall 26 of a tank sump 20, with respect to axis L1 of collar 22 as described in detail below. This angular skewing may be performed while maintaining a seal around the entire periphery of tank sump 20. In some cases, this seal may be substantially fluid-tight through appropriate tolerancing and/or gasket materials, or the seal may be made fluid-tight with caulking or other sealant after adjustment. In the illustrated embodiment, the seal is formed by a continuous line of contact around the periphery, as also further described below.

Tank sumps 20 are shown in FIG. 1 in the context of fueling station 10, and are schematically illustrated as having generally cylindrical containment sump walls 26 mated to a generally cylindrical tank collar 22. In the illustrative embodiment of FIG. 2A, by contrast, tank sump 20 has a generally polygonal exterior but a cylindrical lower end, as described in detail below. For purposes of the present disclosure, tank sumps 20 shown in FIG. 1 can be considered interchangeable with the exemplary tank sump 20 shown in FIG. 2A.

Turning now to FIGS. 5-8, collar 22 has a lower portion including flange 40, which is sized and configured to be welded, adhered or otherwise affixed to the cylindrical outer wall of UST 14 (FIG. 9). When so fixed, the lower end surface of flange 40 forms a fluid-tight junction between with the abutting outer surface of UST 14. In one exemplary embodiment, UST 14 is made of metal with a fiberglass coating applied to the exterior surface of the metal. One or more tank collars 22, which may also be made of fiberglass, are attached and fixed to the exterior fiberglass surface of UST 14 during manufacture in accordance with conventional fiberglass joining techniques.

In the illustrated embodiment, flange 40 forms a curved surface configured to mate with, and conform to, the cylindrical outer surface of UST 14. Thus, the curved surface on the lower end of flange 40 defines its own longitudinal axis L3 (FIG. 8) which is perpendicular to longitudinal axis L1 of the cylindrical wall of tank collar 22. When mounted to UST 14, the curved lower surface of flange 40 mates with the correspondingly cylindrical outer surface of UST 14 such that longitudinal axis L3 of flange 40 is coincident with the longitudinal axis of the cylinder formed by UST 14. Of course, if UST has a shape other than cylindrical, such as cuboid or ellipsoid, the curvature of the lower surface of flange 40 may be adjusted to mate with such shape.

In the illustrated embodiment, flange 40 extends radially outwardly from the otherwise cylindrical sidewall of collar 22, though an inwardly-facing design may also be utilized, or flange 40 may be omitted entirely in favor of a direct interface between the lower end of the cylindrical sidewall and the adjacent mating surface.

Figure 5:
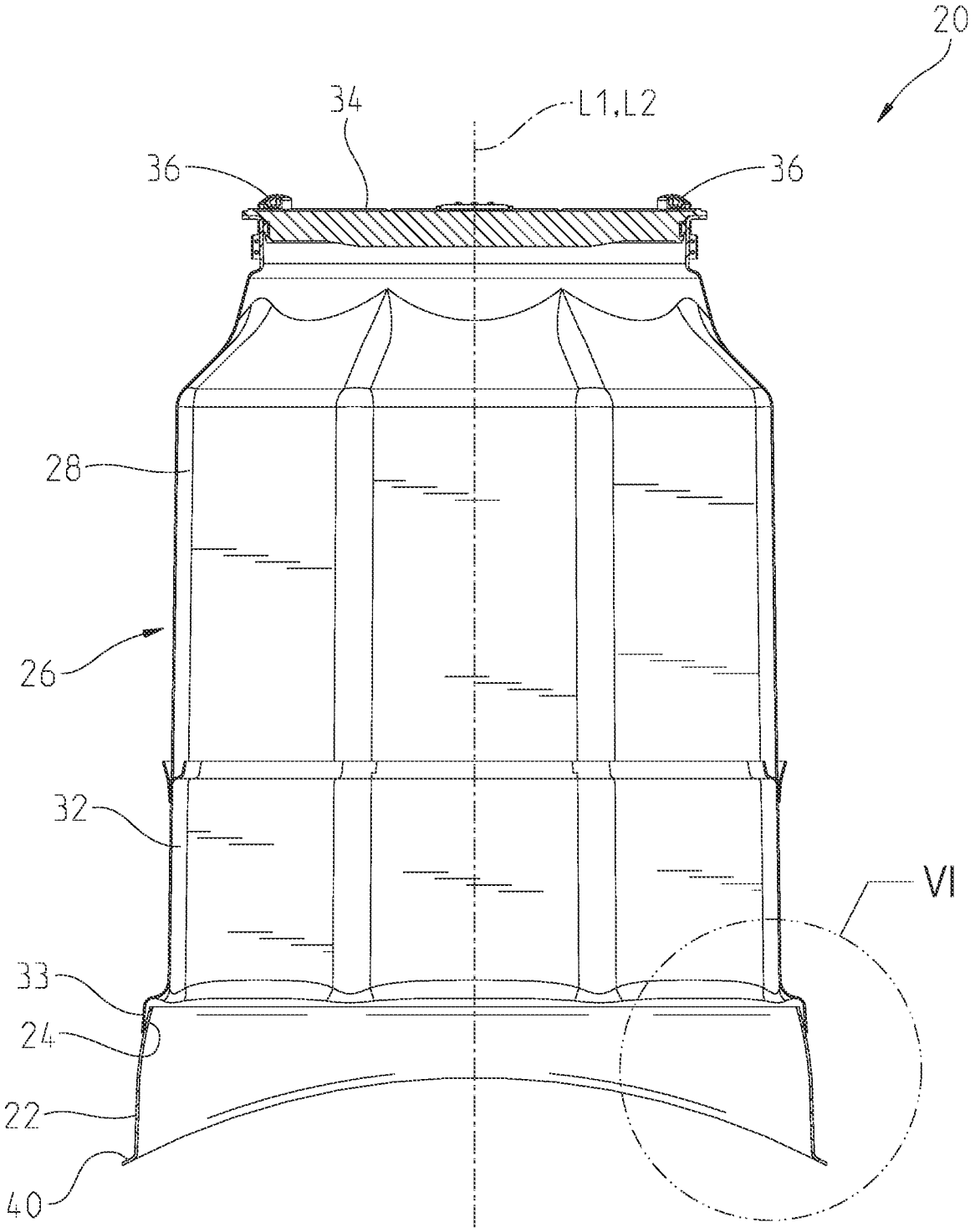
FIG. 5 is a side elevation, cross-section view of the containment sump assembly shown in FIG. 2A, taken along the line V-V of FIG. 4.

The upper portion of collar 22, opposite the lower portion, presents an upper end surface configured to receive the outer containment sump wall assembly 26, as best seen in FIG. 5 and described in further detail below.

Figure 2A:
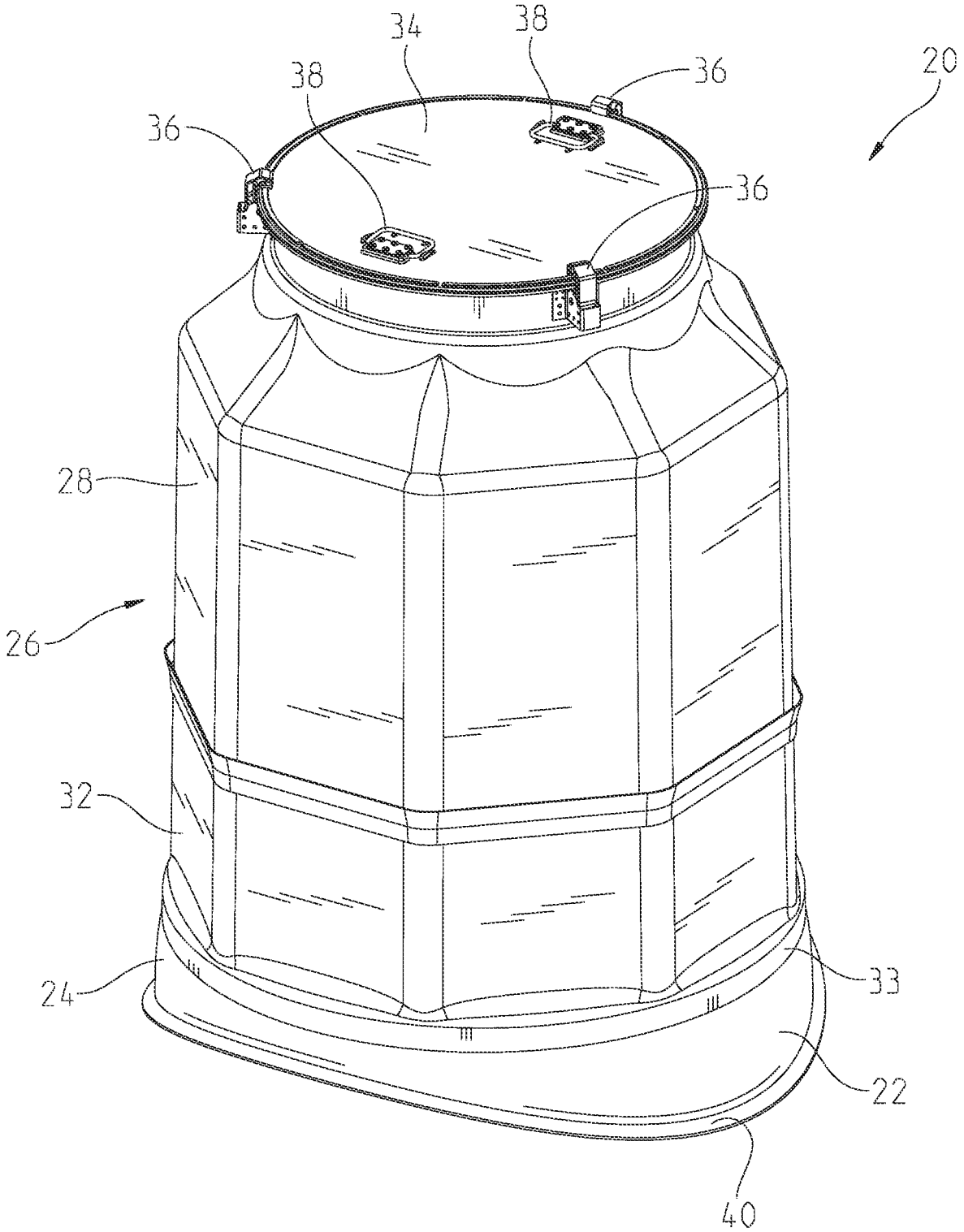
FIG. 2A is a perspective view of a containment sump assembly having a tank collar made in accordance with the present disclosure.
Figure 2B:
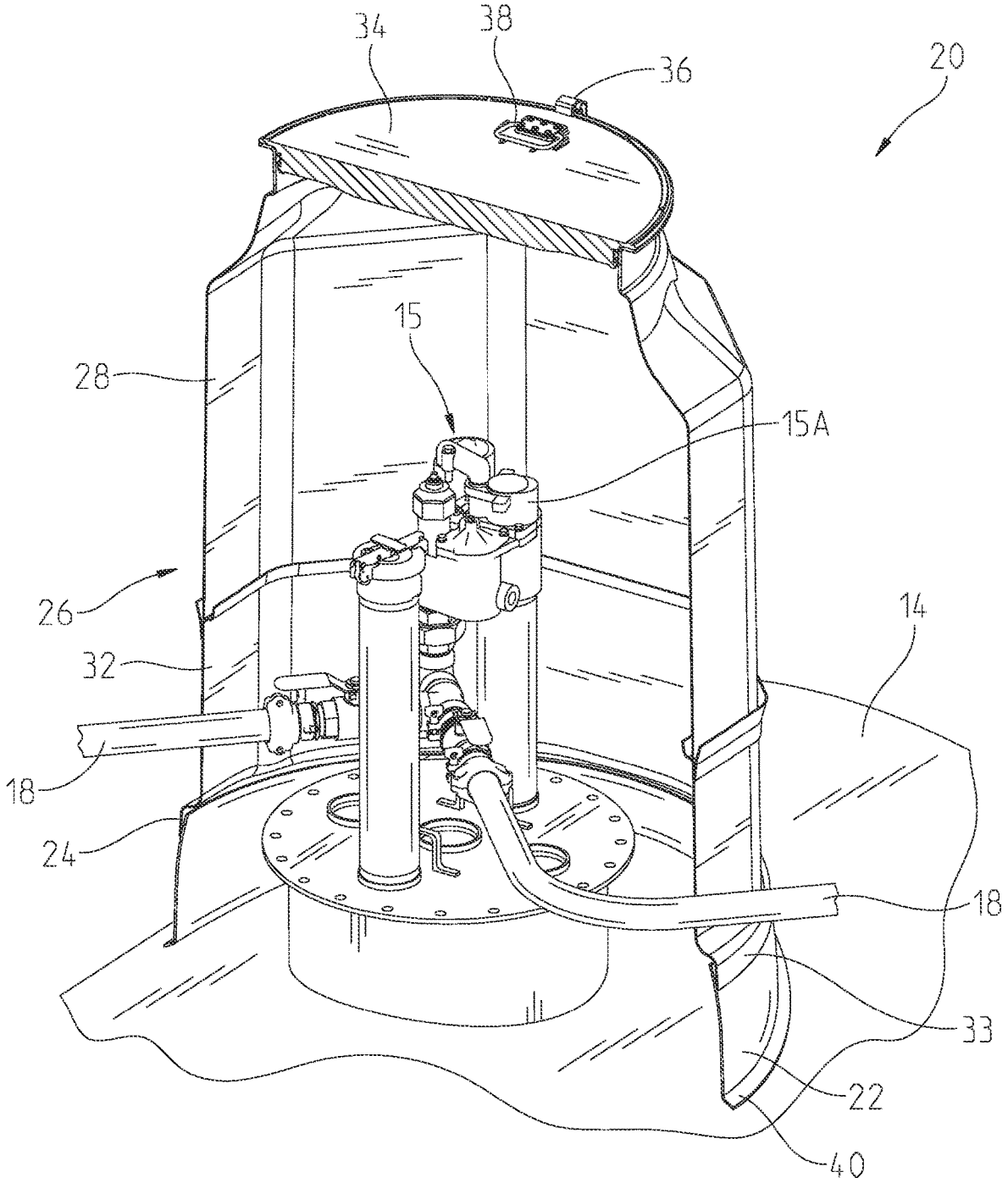
FIG. 2B is another perspective, section view of the containment sump assembly shown in FIG. 2A.
Figure 3:
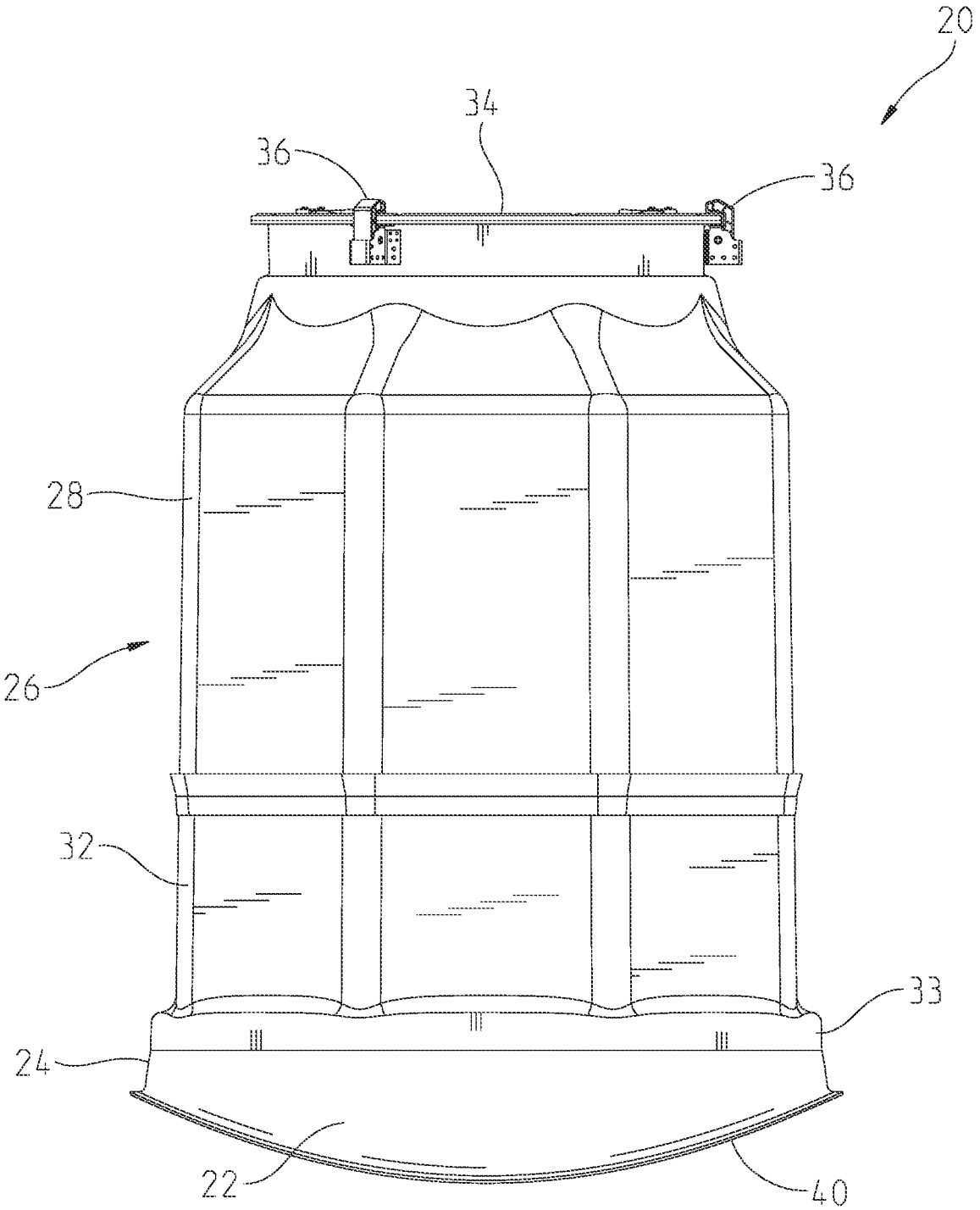
FIG. 3 is a side elevation view of the containment sump assembly shown in FIG. 2A.
Figure 4:
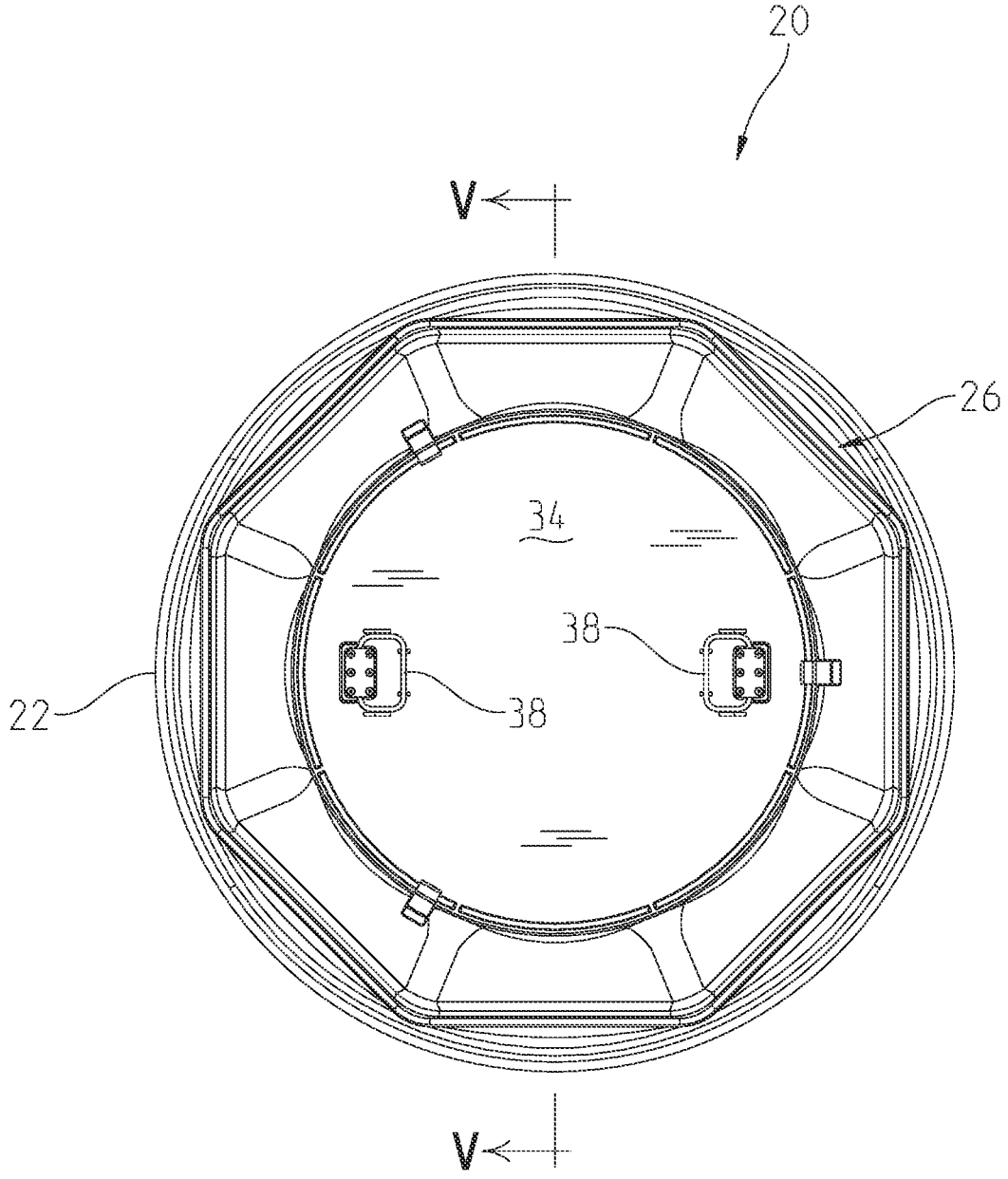
FIG. 4 is a top plan view of the containment sump assembly shown in FIG. 2A.

As best seen in FIGS. 2A, 3 and 5, an exemplary containment wall assembly 26 includes an upper wall 28 and a lower wall 32 which are interconnected (e.g., by welding) to form an integral, generally barrel-shaped wall which can provide for fluid tight containment of liquid. Upper wall 28 has an upper end which receives lid 34, which provides a fluid-tight seal of the interior cavity defined by containment wall assembly 26 at the upper end thereof. Lid 34 may be secured to upper wall 28 of assembly 26 by a series of latches 36, as illustrated in FIGS. 2A and 4. Handles 38 may be attached to lid 34 to facilitate installation and removal by an operator.

Figure 6:
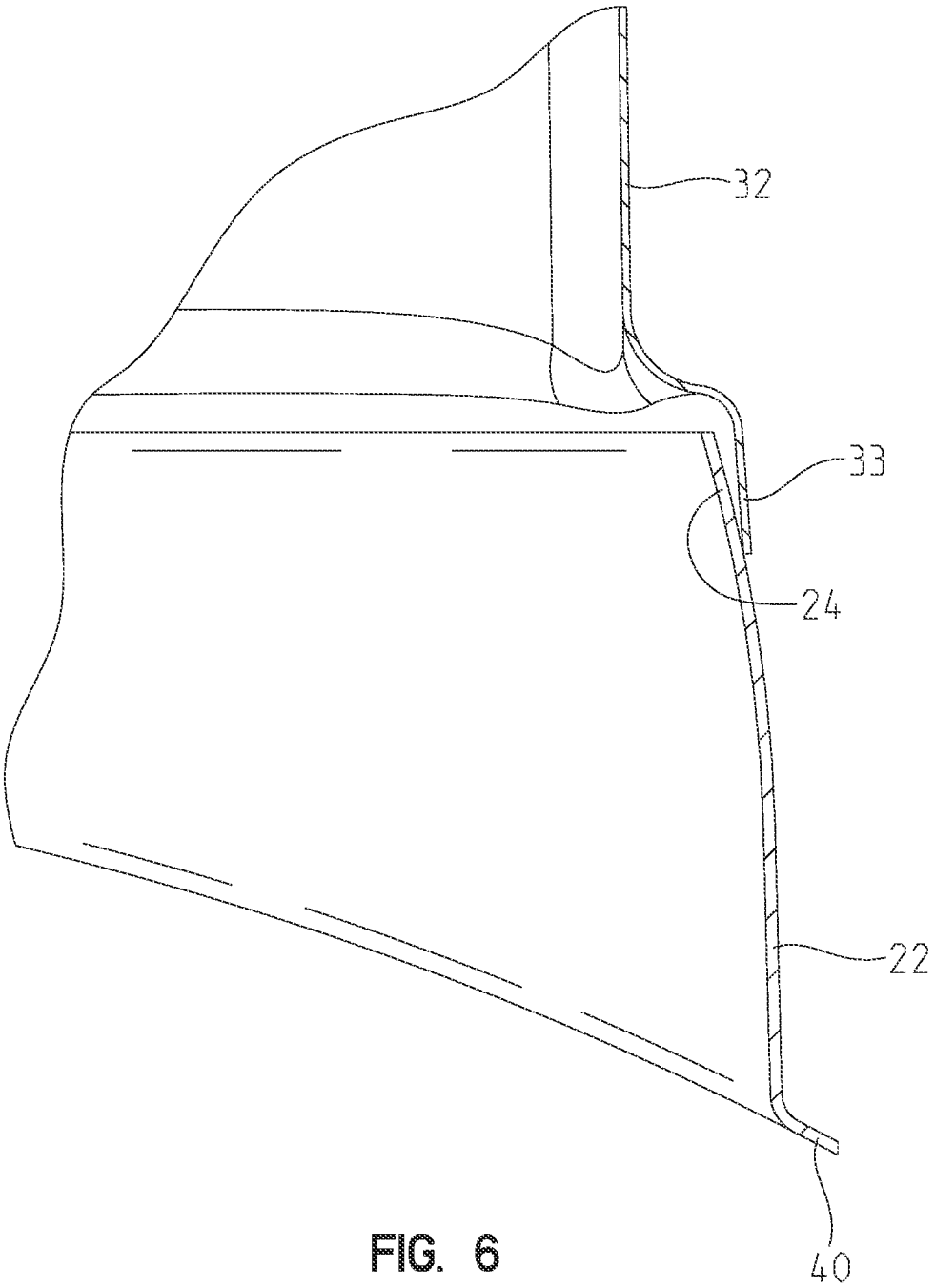
FIG. 6 is an enlarged elevation view of a portion of the containment sump assembly shown in FIG. 5, illustrating an interface between the tank collar and the containment sump wall.
Figure 7:
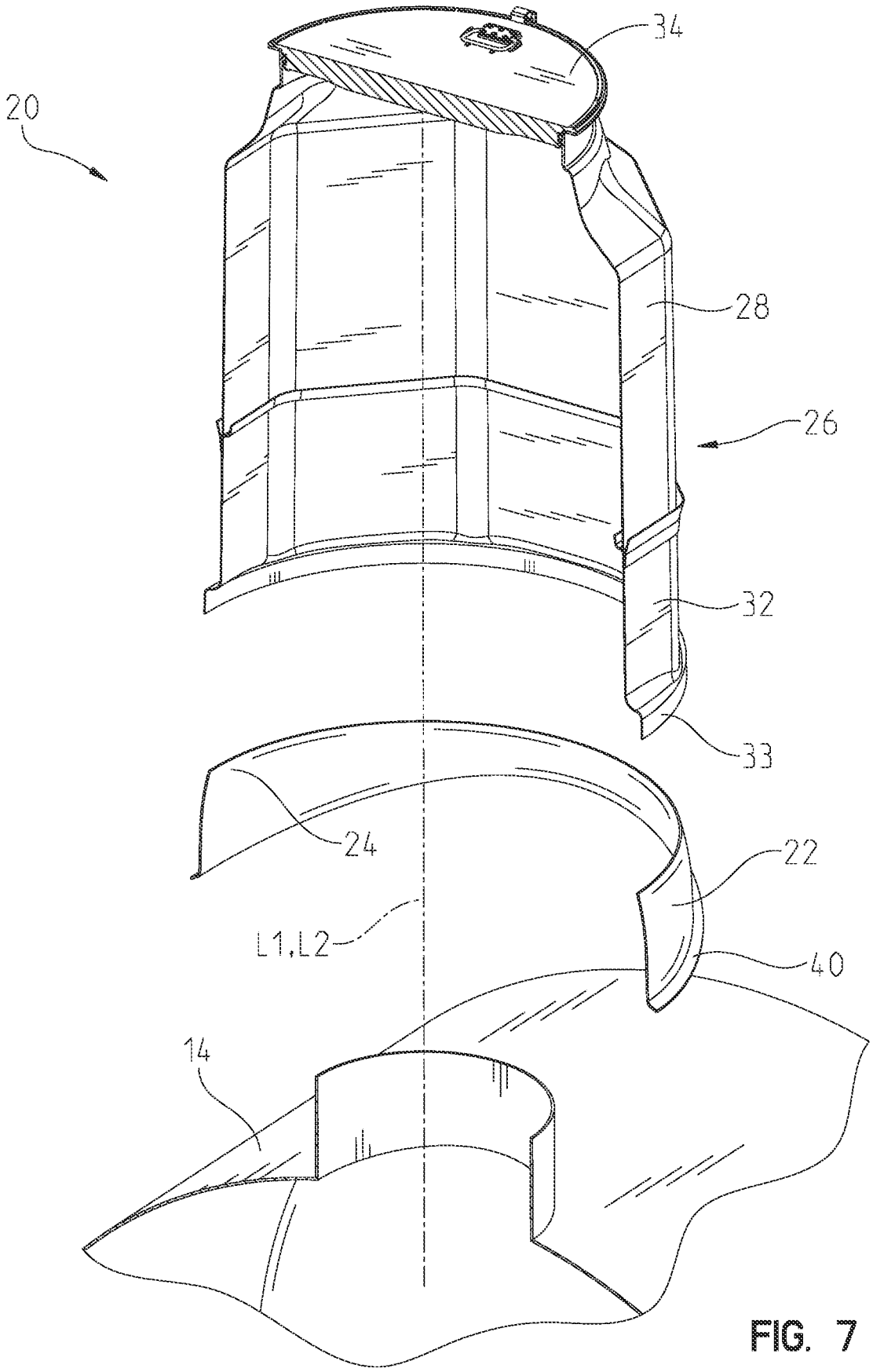
FIG. 7 is a perspective, exploded view of the containment sump assembly shown in FIG. 2A, together with a schematically illustrated underground storage tank.
Figure 8:
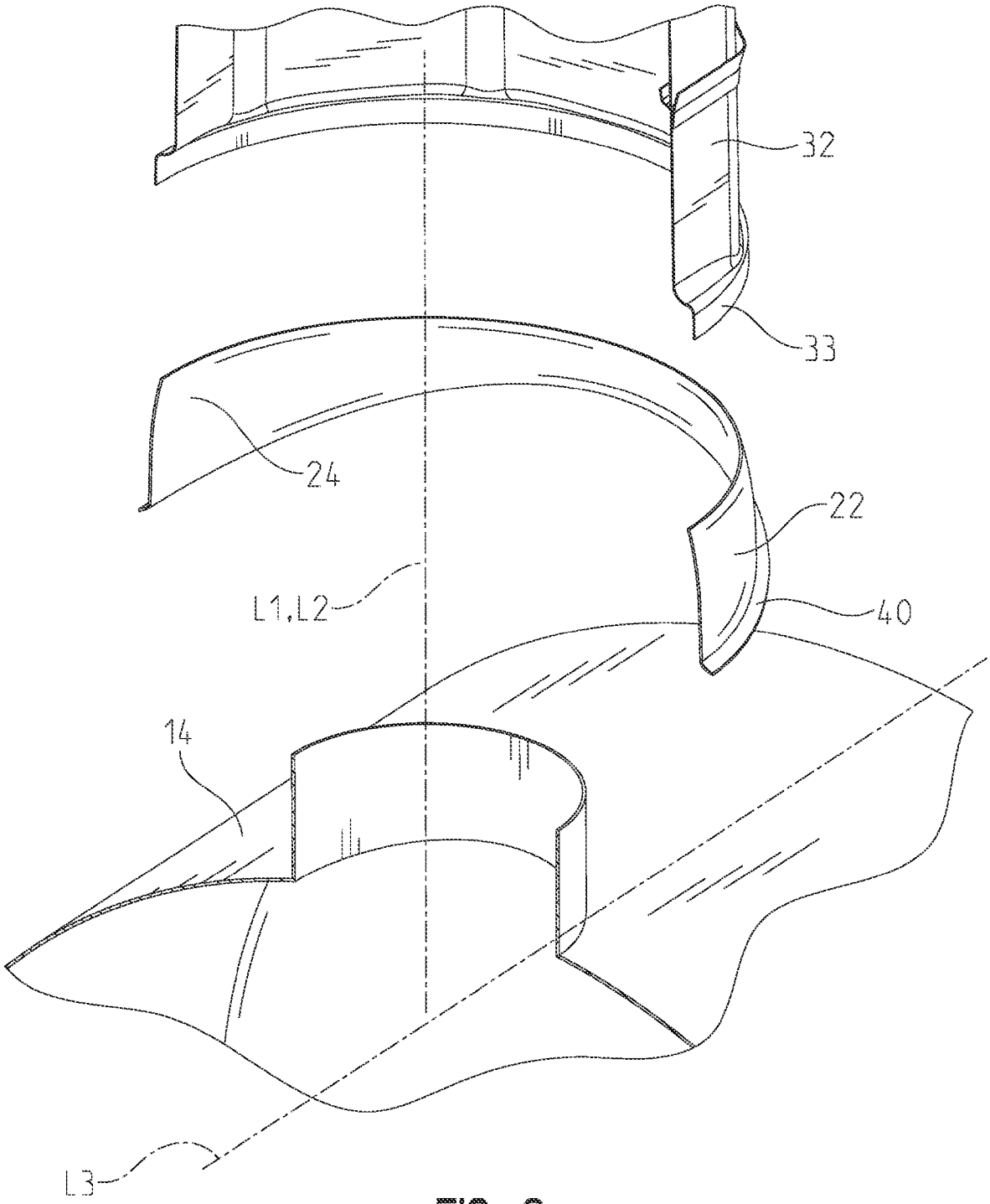
FIG. 8 is an enlarged view of a portion of the assembly shown in FIG. 7.

The lower end surface of lower wall 32 is best seen in FIGS. 5 and 6. In the illustrated embodiment, this lower end includes a cylindrical flange 33 which extends radially outwardly and downwardly away from the polygonal sidewall of the rest of wall assembly 26. Cylindrical flange 33 defines an interior diameter greater than the exterior diameter at the upper end of rounded upper lip 24 of tank collar 22, such that a portion of upper lip 24 is receivable within cylindrical flange 33 of lower wall 32 as shown in FIGS. 10A, 10B and 11. At the same time, the interior diameter of cylindrical flange 33 is less than the exterior diameter of the lower portion of upper lip 24, where its rounded profile meets the cylindrical outer wall of tank collar 22 (FIG. 6). Therefore, the inner lower surface of cylindrical flange 33 (shown in FIG. 6 as an edge) forms a continuous line of contact with the rounded outer surface of upper lip 24 when containment sump wall assembly 26 is mounted to tank collar 22 and allowed to rest thereupon under its own weight. This line of contact may form a seal which, in some embodiments, may be substantially fluid-tight interface. In one exemplary embodiment configured for use in fueling station 10 (FIG. 1), the interior diameter of cylindrical flange 33 is about 48 inches, and the overall interior height of the sump containment wall 26 is about 60 inches as measured from the bottom of collar 22 to the top of lid 34.

The line of contact formed between flange 33 and rounded lip 24, best seen in FIG. 6, may also be an area of contact. For example, flange 33 may have a concave spheroidal surface designed to engage the corresponding convex spheroidal surface of lip 24.

In addition, the outwardly-facing convex articulation surface formed by rounded lip 24 may be reversed to a concave spheroid surface, such that lip 24 would form a "cup-shaped" structure which can receive flange 33 while providing angular adjustability in a similar manner. Such a concave surface may curve outwardly from the sidewall of collar 22, rather than the inwardly-extending lip 24 shown in FIG. 6.

The interface between tank collar 22 and wall assembly 26 allows for angular adjustment of wall assembly 26 with respect to collar 22 and, by extension, UST 14, without disrupting the continuous line of contact described herein. As noted herein, tank collar 22 has a cylindrical sidewall defining a first longitudinal axis L1 (FIGS. 10A, 10B and 11). More generally, flange 40 and rounded upper lip 24 of tank collar are generally symmetrical about axis L1 except that flange 40 extends axially downwardly by a varying amount around its periphery to form a continuous contact with the cylindrical outer surface of UST 14 (FIGS. 7-9), as described above. Similarly, wall assembly 26 defines a second longitudinal axis L2 (FIGS. 10A, 10B and 11), about which the features and structures of containment assembly 26 are symmetrical.

As best seen by a comparison of FIGS. 10A and 10B and 11, axes L1 and L2 may be aligned with one another (FIG. 11) such that they are parallel and coincident, or axes L and L2 may be askew (FIGS. 10A and 10B) such that angle $\alpha$ is formed therebetween. This angular adjustment can be made without any disruption of the seal (e.g., the fluid-tight connection) between cylindrical flange 33 and upper lip 24, as shown in FIGS. 10A and 10B, because a continuous line of contact remains in place as the lower-inner edge of flange 33 rides over the spheroid (e.g., generally spherical) surface defined by rounded upper lip 24. In effect, this configuration creates a ball-and-socket joint at the interface between wall assembly 26 and tank collar 22, thereby allowing for a continuous field of adjustment as described below.

In the illustrated embodiment, wall assembly 26 is angularly adjustable in any direction away from the aligned position shown in FIG. 11 within a predetermined angular range of motion. That is, wall assembly 26 may be adjusted through a conical range of motion, with the range of positions of axis L2 forming a cone around the tank-collar axis L1 as the stationary centerline of the cone. For example, FIG. 10A, shows an adjustment in which angle $\alpha$ is formed in a first plane, while FIG. 10B shows an adjustment in which angle $\alpha$ is formed in a second, perpendicular plane.

In the illustrated embodiment, the predetermined extent of potential angular adjustment is correlated with the angular extent of the rounded upper lip 24. As long as the continuous, substantially fluid-tight line of contact between flange 33 rides and rounded upper lip 24 is maintained, the angular adjustment is within the permissible range. In one exemplary embodiment, wall assembly 26 may be adjusted as much as 1, 2 or 3 degrees in any direction from its aligned position (FIG. 11), for a total angular sweep of as much as 2, 4 or 6 degrees.

The angular adjustability of containment wall 26 with respect to tank collar 22 allows an installer of UST 14 and containment sump 20 to compensate for angular irregularities which may arise from imperfect underground orientation of UST 14, or from an imperfect mounting of collar 22 on UST 14. For example, tank collar 22 may be affixed (e.g., by welding) to the outer surface of a UST 14 during fabrication or after the UST has been placed underground (but before completing the backfilling of material around the UST 14). If it is found that the longitudinal axis L1 of tank collar 22 is not sufficiently perpendicular with the intended grade plane (i.e., UST is installed out of plumb), containment wall 26 may be angularly adjusted such that longitudinal axis L2 is perpendicular to the grade plane within predetermined tolerance limits (e.g., within 0.5 degrees). This allows for flexible, in-the-field adjustment of the angular arrangement of containment wall 26 with respect to tank collar 22 and UST 14, while avoiding any undue stresses on the various structures and preserving the seal created by the uninterrupted line of contact around the periphery of the interface between wall 26 and collar 22. Once the proper angular orientation has been established, containment wall 26 may be locked in place, such as by sealing around the interface between flange 33 and upper lip 24. In an exemplary embodiment, tank collar 22 and wall assembly 26 are both made of a fiberglass material, such that the two material are joined by adhesives, putties and/or structural tapes in a manner consistent with conventional fiberglass joining techniques.

In the illustrated embodiment, cylindrical flange 33 is received over rounded upper lip 24 (as described in detail above) to facilitate compatibility of tank collar 22 with other industry-standard containment sumps, which typically have similarly cylindrical lower ends. However, alternative arrangements in accordance with the present disclosure are also contemplated beyond the exemplary configuration shown in the drawings. For example, an alternative to the inner-lower edge of flange 33 riding on the convex exterior surface of upper lip 24, as shown in FIG. 6, would be for the outer-lower edge of flange 33 to be received within a concave upper lip as described above. This arrangement could be the same as shown in FIG. 6, except with upper lip 24 bending radially outwardly rather than radially inwardly as shown. Additionally, the rounded lip of tank collar 22 may be formed as a part of containment wall 26, and cylindrical flange 33 of containment wall 26 may formed as a part of tank collar 22. Such a reversal of components may be made in any combination or permutation with the alternative systems designs described herein. Moreover, other flexible connections which maintain a substantially fluid-tight seal despite askew axes L1 and L2 may be used in accordance with the present disclosure, as required or desired for a particular application.

The other structures associated with (e.g., contained within) sump 20 may include riser pipes, drain valves, monitoring equipment, piping, or any other structures or devices associated with the operation of fueling station 10, some of which are shown in FIG. 2B and described above.

In one exemplary embodiment, tank sumps 20 and/or dispenser sumps 30 may have a double-walled construction including primary and secondary containers with an interstitial space located between their respective walls, with such interstitial space extending partially or completely up the height of the double-walled container. For monitored containment sumps, this interstitial space may be monitored to ensure there are no leaks in either of the two walls. As an example, a vacuum can be created within the interstitial space and the vacuum pressure can be monitored to consistency over time. A consistent vacuum provides evidence that there are no leaks in either the primary or secondary wall. One such pressure monitoring system used for traditional double-wall containment systems can be found in U.S. Pat. No. 7,578,169, filed Dec. 31, 2007 and entitled METHOD AND APPARATUS FOR CONTINUOUSLY MONITORING INTERSTITIAL REGIONS IN GASOLINE STORAGE FACILITIES AND PIPELINES, the entire disclosure of which is hereby expressly incorporated herein by reference. Further details of interstitial monitoring systems and the context of double-walled containment sumps may be found in U.S. Pat. No. 8,684,024, filed Oct. 14, 2010 and entitled "SPILL CONTAINMENT SYSTEM", the entire disclosure of which is hereby expressly incorporated herein by reference.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A containment sump comprising:

a tank collar comprising:

a lower portion having a lower end shaped to form a lower fluid-tight seal with an external surface of an underground storage tank; and an upper portion having a cylindrical wall terminating in an upper end surface defining a spheroidal mounting surface; and a containment sump wall having a non-spheroidal lower end sealingly engaged with the spheroidal mounting surface of the tank collar, the containment sump wall is angularly adjustable with respect to the tank collar within a predetermined angular range, whereby the spheroidal mounting surface is configured to mate with the containment sump wall to form can form a sealed interface between the upper end surface and the containment sump wall while also allowing angular adjustment of the containment sump wall with respect to the tank collar.

2. The tank collar of claim 1, wherein the upper end surface includes a rounded upper lip defining the spheroidal mounting surface.

3. The tank collar of claim 2, wherein the rounded upper lip curves inwardly from the cylindrical wall toward a longitudinal axis thereof.

4. The tank collar of claim 1, wherein the lower end defines a curved lower surface shaped to conform to a cylindrical external surface of the underground storage tank.

5. The tank collar of claim 1, wherein the tank collar is formed from a fiberglass material.

6. The containment sump of claim 1, wherein the non-spheroidal lower end of the containment sump wall is sealingly engaged with the spheroidal mounting surface of the tank collar to define a non-complementary contact profile therebetween.

7. The containment sump of claim 6, wherein, with the non-spheroidal lower end of the containment sump wall is sealingly engaged with the spheroidal mounting surface of the tank collar, the non-complementary contact profile defines line contact between the containment sump wall and the tank collar.

8. A containment sump comprising:

a tank collar having a cylindrical sidewall with a lower end and an opposing upper end;

a containment sump wall having a lower end sealingly engaged with the upper end of the tank collar to define a continuous non-complementary contact profile extending around the periphery of the lower end of the containment sump wall and the upper end of the tank collar, the containment sump wall is angularly adjustable with respect to the tank collar within a predetermined angular range without disrupting the continuous non-complementary contact profile.

9. The containment sump of claim 8, wherein the tank collar has a first longitudinal axis and the containment sump wall has a second longitudinal axis, the containment sump is angularly adjustable between an aligned position in which the first and second longitudinal axes are parallel and an askew position in which the first and second longitudinal axes are angled with respect to one another.

10. The containment sump of claim 9, wherein the containment sump is angularly adjustable through a conical range of motion with respect to the first longitudinal axis.

11. The containment sump of claim 10, wherein the second longitudinal axis can be angled with respect to the first longitudinal axis by up to 3 degrees in any direction from the aligned position.

12. The containment sump of claim 8, wherein the upper end of the tank collar comprises a rounded lip and the lower end of the containment sump wall comprises a cylindrical flange sized to be seated upon the rounded lip.

13. The containment sump of claim 8, wherein the cylindrical flange extends radially outwardly and downwardly away from a polygonal sidewall, and the rounded upper lip extends radially inwardly from the cylindrical sidewall.

14. The containment sump of claim 13, wherein:

the cylindrical flange defines an interior diameter greater than the exterior diameter at the upper end of the rounded upper lip, the interior diameter of the cylindrical flange is less than the exterior diameter of the lower portion of the upper lip, and such that a portion of the upper lip of the tank collar is receivable within the cylindrical flange of the containment sump.

15. The containment sump of claim 8, wherein the continuous non-complementary contact profile defines line contact between the containment sump wall and the tank collar.

16. The containment sump of claim 8, wherein the lower end of the containment sump wall is a non-spheroidal lower end, and the upper end of the tank collar is a spheroidal upper end which cooperates with the non-spheroidal lower end to form the non-complementary contact profile.

17. A fueling station comprising:

an underground storage tank having a tank collar affixed to an outer surface thereof, the tank collar having a spheroidal upper end; and a containment sump comprising a containment sump wall having a non-spheroidal lower end sealingly engaged with the spheroidal upper end of the tank collar, the containment sump wall is angularly adjustable with respect to the tank collar within a predetermined angular range.

18. The fueling station of claim 17, further comprising a fuel dispenser in fluid communication with the underground storage tank.

19. The fueling station of claim 17, wherein the tank collar has a first longitudinal axis and the containment sump wall has a second longitudinal axis, the containment sump wall is angularly adjustable between an aligned position in which the first and second longitudinal axes are parallel and an askew position in which the first and second longitudinal axes are angled with respect to one another.

20. The fueling station of claim 19, wherein the second longitudinal axis can be angled with respect to the first longitudinal axis by up to 3 degrees in any direction from the aligned position.

21. The containment sump of claim 17, wherein the spheroidal upper end of the tank collar comprises a rounded lip and the non-spheroidal lower end of the containment sump wall comprises a cylindrical flange sized to be seated upon the rounded lip.

22. The fueling station of claim 17, wherein the non-spheroidal lower end of the containment sump wall is sealingly engaged with the spheroidal upper end to define a non-complementary contact profile therebetween.

23. The containment sump of claim 22, wherein, with the non-spheroidal lower end of the containment sump wall sealingly engaged with the spheroidal upper end of the tank collar, the non-complementary contact profile defines line contact between the containment sump wall and the tank collar.

24. A method of assembling a containment sump to an underground storage tank, the method comprising:

installing an underground storage tank below grade, the underground storage tank having a tank collar fixed to an exterior surface thereof;

installing a containment sump wall to the tank collar to create a seal therebetween, the seal formed by a non-complementary contact profile between the containment sump wall and the tank collar; and angularly adjusting the containment sump wall with respect to the tank collar while maintaining the non-complementary contact profile without disrupting the seal.

25. The method of claim 24, wherein the seal is a substantially fluid-tight seal.

26. The method of claim 24, wherein the step of angularly adjusting comprises angling a longitudinal axis of the containment sump with respect to a longitudinal axis of the tank collar within a predetermined angular range.

27. The method of claim 24, wherein the non-complementary contact profile defines line contact between the containment sump wall and the tank collar.

28. The method of claim 24, wherein the containment sump wall has a non-spheroidal lower end and the tank collar has a spheroidal upper end which cooperates with the non-spheroidal lower end to form the non-complementary contact profile between the containment sump wall and the tank collar.

* * * * *